US006431897B1

(12) United States Patent
Hashiguchi et al.

(10) Patent No.: US 6,431,897 B1
(45) Date of Patent: Aug. 13, 2002

(54) CONNECTOR HAVING A ROTARY ACTUATOR ENGAGED WITH A CONTACT IN A DIRECTION PARALLEL TO A SHEET-LIKE OBJECT CONNECTED TO THE CONNECTOR

(75) Inventors: Osamu Hashiguchi, Akishima; Kanji Inoue, Tokyo, both of (JP)

(73) Assignee: Japan Aviation Electroncis Industry Limited, Tokyo (JP)

( * ) Notice: Subject to any disclaimer, the term of this patent is extended or adjusted under 35 U.S.C. 154(b) by 0 days.

(21) Appl. No.: 09/678,813

(22) Filed: Oct. 4, 2000

(30) Foreign Application Priority Data

Oct. 6, 1999 (JP) ..... 11-285495
Nov. 11, 1999 (JP) ..... 11-320609
Apr. 20, 2000 (JP) ..... 2000-119991

(51) Int. Cl.[7] ..... H01R 11/22
(52) U.S. Cl. ..... 439/267
(58) Field of Search ..... 439/267, 329, 439/493, 259, 260, 261, 262, 263, 264, 265, 266–268, 59, 65, 67, 79

(56) References Cited

U.S. PATENT DOCUMENTS 4,252,392 A * 2/1981 Whiteman, Jr. ..... 439/267
5,173,058 A * 12/1992 Broeksteeg ..... 439/267
6,030,243 A * 2/2000 Harting et al. ..... 439/260

FOREIGN PATENT DOCUMENTS

GB 2120466 * 4/1963 ..... 439/267
JP 9-35828 2/1997 ..... H01R/23/68
JP 9-92411 4/1997 ..... H01R/23/68

* cited by examiner

*Primary Examiner*—Brian Sircus
*Assistant Examiner*—J. F. Duverne
(74) *Attorney, Agent, or Firm*—Michael Best & Friedrich LLC; J. Warren Whitesel

(57) ABSTRACT

In a connector having a rotary actuator (14) for bringing a sheet-like object (11) into press contact with a contact (13) held by a housing (12), the rotary actuator is engaged with the contact in a predetermined direction parallel to the sheet-like object and perpendicular to a center axis of a shaft portion (22) of the rotary actuator. The shaft portion is rotatably engaged with the housing. The contact has a contacting portion (15) to be faced to one surface of the sheet-like object and a supporting portion (16) to be faced to the other surface of the sheet-like object. The actuator has a cam portion (21) integrally connected to the shaft portion and located between the supporting portion and the sheet-like object. The supporting portion has a recess (17) which receives the cam portion to engage the cam portion with the supporting portion in the predetermined direction.

16 Claims, 16 Drawing Sheets

CONNECTOR HAVING A ROTARY ACTUATOR ENGAGED WITH A CONTACT IN A DIRECTION PARALLEL TO A SHEET-LIKE OBJECT CONNECTED TO THE CONNECTOR

BACKGROUND OF THE INVENTION

This invention relates to a connector for connecting a sheet-like object such as a flexible flat cable (FFC) and a flexible printed circuit (FPC).

A conventional connector of the type is disclosed, for example, in Japanese Unexamined Patent Publications (JP-A) Nos. H09-35828 and H09-92411. The conventional connector comprises a plurality of contacts each of which has a contacting portion to be faced to one surface of a sheet-like object such as a FFC or a FPC and a supporting portion to be faced to the other surface of the sheet-like object which is opposite to the one surface, a housing holding the contacts, and an actuator for bringing the sheet-like object into press contact with the contacting portions of the contacts. The actuator has a cam portion inserted into the housing from its front side and rotatably coupled thereto.

In order to connect the sheet-like object, the sheet-like object is at first inserted into the connector from the front side thereof to an area between the contacting portions of the contacts and the cam portion of the actuator. Then, the actuator is rotated so that the cam portion of the actuator brings the sheet-like object into press contact with the contacting portions of the contacts. Thus, the sheet-like object is connected to the connector by such a simple operation. The connector of the type described will hereinafter called a rotary-actuation connector.

In the conventional rotary-actuation connector mentioned above, the actuator is coupled to the housing simply by engagement between both ends of the actuator and the housing. With this structure, the actuator is often released or disengaged from the housing. For example, if the sheet-like object is subjected to pull force while it is brought into contact with the contacting portions of the contacts, the cam portion of the actuator is also pulled due to friction between the sheet-like object and the cam portion. In this event, the actuator will undesiredly be released from the housing.

SUMMARY OF THE INVENTION

It is therefore an object of the present invention to provide a rotary-actuation connector which is capable of suppressing the risk of disengagement of an actuator even if a sheet-like object connected to the connector is subjected to pull force.

It is another object of the present invention to provide a rotary-actuation connector which is capable of preventing disengagement of an actuator with high reliability and without increasing the height of the connector.

It is still another object of the present invention to provide a rotary-actuation connector in which an actuator is easily coupled and prevented from disengagement with high reliability.

Other objects of the present invention will become clear as the description proceeds.

According to an aspect of the present invention, there is provided a connector for use in connecting a sheet-like object. The connector comprises a contact having a contacting portion to be faced to one surface of the sheet-like object and a supporting portion to be faced to the other surface of the sheet-like object which is opposite to the one surface, a housing holding the contact, and an actuator for bringing the sheet-like object into press contact with the contacting portion. The actuator comprises a cam portion located between the supporting portion and the sheet-like object and a shaft portion integrally connected with the cam portion and rotatably engaged with the housing. The supporting portion has a recess which receives the cam portion to make the cam portion and the supporting portion be engaged with each other in a predetermined direction parallel to the sheet-like object and perpendicular to a center axis of the shaft portion.

According to another aspect of the present invention, there is provided a connector for use in connecting a sheet-like object. The connector comprises a first contact having a first contacting portion to be faced to one surface of the sheet-like object and a first supporting portion to be faced to the other surface of the sheet-like object which is opposite to the one surface, a second contact having a second contacting portion to be faced to the one surface of a sheet-like object and a second supporting portion to be faced to the other surface of the sheet-like object, a housing holding the first and the second contacts at a predetermined pitch, and an actuator for bringing the sheet-like object into press contact with the first and the second contacting portions. The actuator comprises a first cam portion located between the first supporting portion and the sheet-like object, a second cam portion located between the second supporting portion and the sheet-like object, and a shaft portion integrally connected with the first and the second cam portions and rotatably engaged with the housing. The first supporting portion has a recess which receives the first cam portion to make the first cam portion and the first supporting portion be engaged with each other in a predetermined direction parallel to the sheet-like object and perpendicular to a center axis of the shaft portion.

DESCRIPTION OF THE PREFERRED EMBODIMENTS

Figure 1:
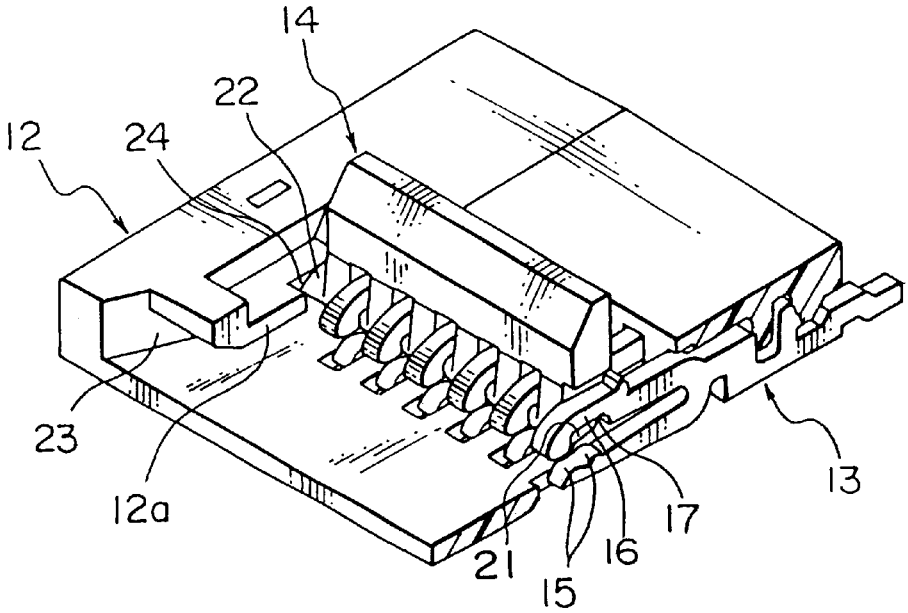
FIG. 1 is a perspective view of a characteristic part of a connector according to a first embodiment of the present invention.
Figure 2:
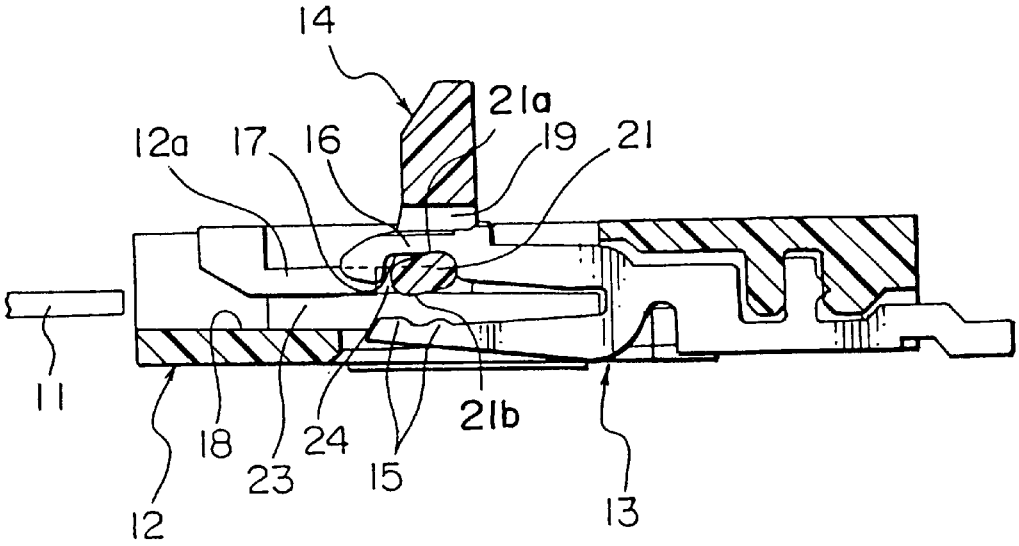
FIG. 2 is a sectional view of the connector illustrated in FIG. 1.

Referring to FIGS. 1 and 2, description will be made of a connector according to a first embodiment of the present invention.

The connector comprises an insulator housing 12 for receiving an FPC 11 as one of sheet-like objects to be connected thereto, a number of conductive elastic contacts 13 arranged in the housing 12 at a predetermined pitch in a transversal direction and fixedly held by the housing 12, and an insulating actuator 14 for bringing the FPC 11 into press contact with the contacts 13.

Each of the contacts 13 has two contacting portions 15 to be faced to one surface of the FPC 11 and a supporting portion 16 integrally connected to the contacting portion 15 to be faced to the other surface of the FPC 11 which is opposite to the one surface. The contacting portion 15 and the supporting portion 16 are faced to each other in a vertical direction as a first direction with a predetermined space kept therebetween. The supporting portion 16 is provided with a recess 17 formed at a position faced to the contacting portion 15.

The housing 12 is provided with an FPC insert portion 18 in conformity with the predetermined space. The FPC 11 is inserted into the FPC insert portion 18 in a back-and-forth direction as a second direction or a predetermined direction perpendicular to the first direction. Since the space between the contacting portion 15 and the supporting portion 16 is sufficiently greater than the thickness of the FPC 11, the FPC 11 can easily be inserted.

The actuator 14 comprises a plate-like member extending in the transversal direction and is provided with a number of through holes 19 in one-to-one correspondence to the supporting portions 16 of the contacts 13. With the supporting portions 16 inserted into the holes 19, the actuator 14 is coupled to the housing 12. Each of the through holes 19 has such a size that allows insertion of the supporting portion 16 with a gap therearound.

The actuator 14 has a number of cam portions 21 each of which is located in the recess 17 of the supporting portion 16 when the actuator 14 is coupled to the housing 12. In the illustrated embodiment, each of the cam portions 21 has a section defined by two semicircles connected by two straight lines. However, the shape of the cam portion 21 may be modified in various manners. Thus, the actuator 14 is engaged with the supporting portions 16 to be rotatable around the cam portions 21.

Furthermore, the actuator 14 has a pair of shaft portions 22 formed at both transversal ends thereof. On the other hand, the housing 12 has a pair of guide grooves 23 extending in the back-and-forth direction or the second direction, and a pair of engaging grooves 24 each of which is connected to a rear end of the guide groove 23 and extending upward therefrom. The guide grooves 23 serve to guide the shaft portions 22 to introduce each cam portion 21 to an area between the contacting portion 15 and the supporting portion 16 when the actuator 14 is coupled. Each of the engaging grooves 24 is formed as a notch in a wall portion 12*a* defining an upper wall of the guide groove 23 and allows the shaft portion 22 to move upward so that the cam portion 21 is moved towards the supporting portion 16. Thus, the engaging grooves 24 engaged with the shaft portions 22 and the supporting portions 16 engaged with the cam portions 21 cooperate to rotatably support the actuator 14.

Figure 3A:
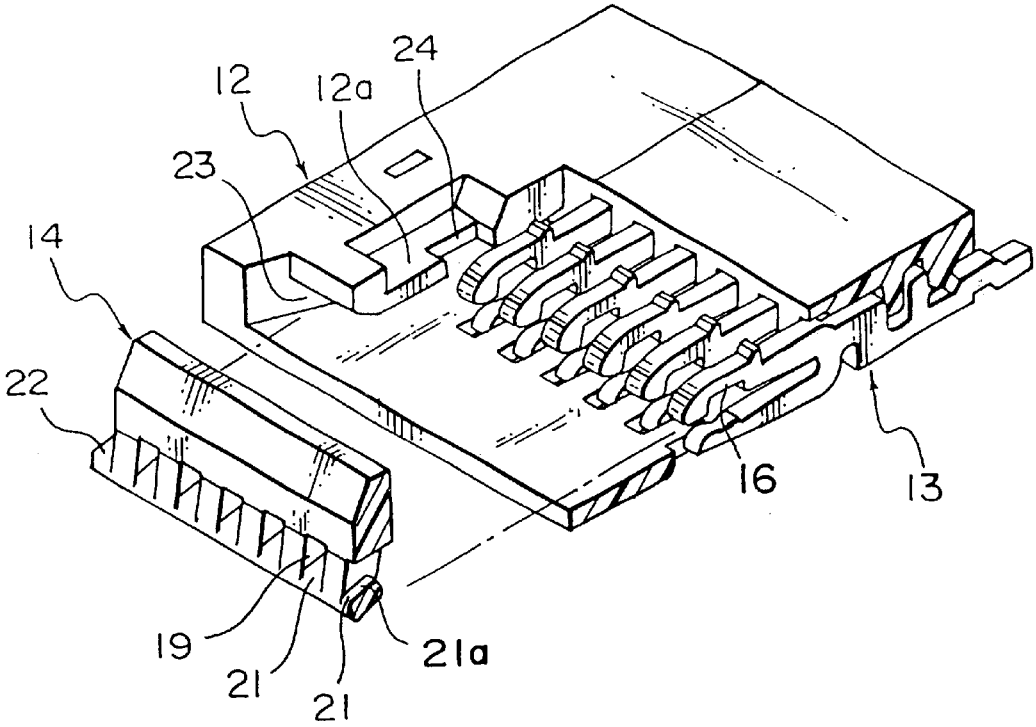
FIG. 3A is a perspective view of the characteristic part of the connector illustrated in FIG. 1 in a state in which an actuator is decoupled from a housing.
Figure 3B:
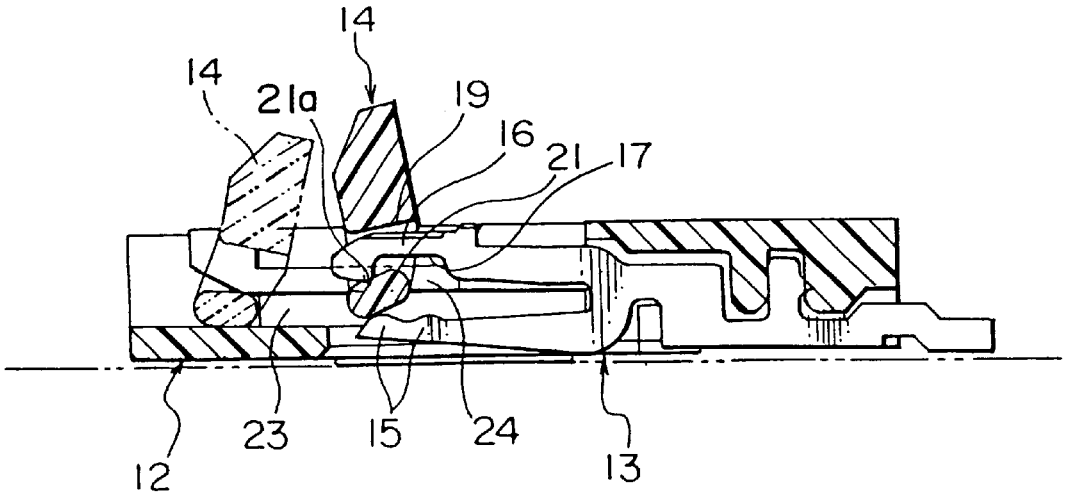
FIG. 3B is a sectional view of the connector illustrated in FIG. 1 during a coupling operation of the actuator.

Referring to FIGS. 3A and 3B, description will be made of an operation of coupling the actuator 14 to the housing 12. At first, the actuator 14 is located in front of the housing 12 as depicted by dash-and-dot lines in FIG. 3B. Then, the actuator 14 is moved rearward with the shaft portions 22 guided by the guide grooves 23. As a consequence, the cam portion 21 is introduced into the area between the contacting portion 15 and the supporting portion 16 of the contact 13 as depicted by solid lines in FIG. 3B. When the shaft portion 22 reaches a rear end of the guide groove 23, the actuator 14 is moved upward to insert the shaft portion 22 into the engaging groove 24. Simultaneously, the cam portion 21 is fitted into the recess 17 of the supporting portion 16, so that an engaging cam surface 21*a* of the cam portion 21 is engaged with the supporting portion 16 in each of the upper direction and the back-and-forth direction of the second direction. Thus, the connector illustrated in FIGS. 1 and 2 is obtained.

Figure 4A:
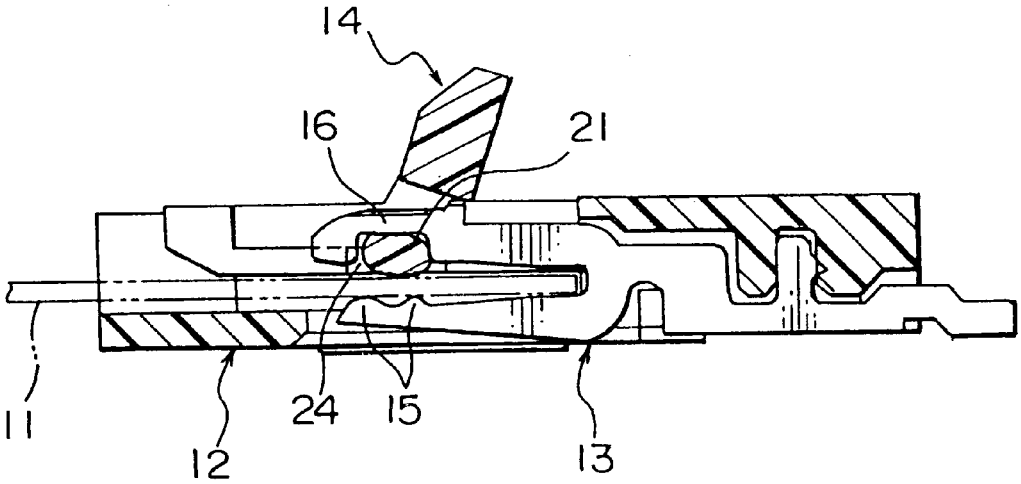
FIG. 4A is a sectional view of the connector illustrated in FIG. 1 with the actuator in an opened state.

Next referring to FIGS. 4A and 4B, description will be made of an operation of connecting the FPC 11 by the use of the above-mentioned connector. When the actuator 14 is located at a first position where the actuator 14 is opened as illustrated in FIG. 4A, the cam portion 21 is held in the recess 17 in a laid position. As a result, a space greater than the thickness of the FPC 11 is kept between the contacting portion 15 of the contact 13 and the cam portion 21. Therefore, when the actuator is located at the first position, the FPC 11 can easily be inserted into the FPC insert portion 18 of the housing 12.

Figure 4B:
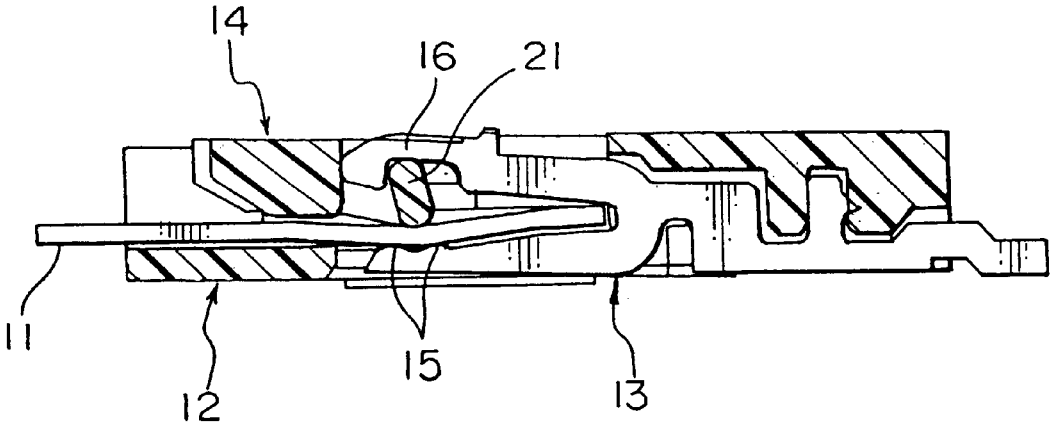
FIG. 4B is a sectional view of the connector illustrated in FIG. 1 with a sheet-like object connected thereto.
Figure 5:
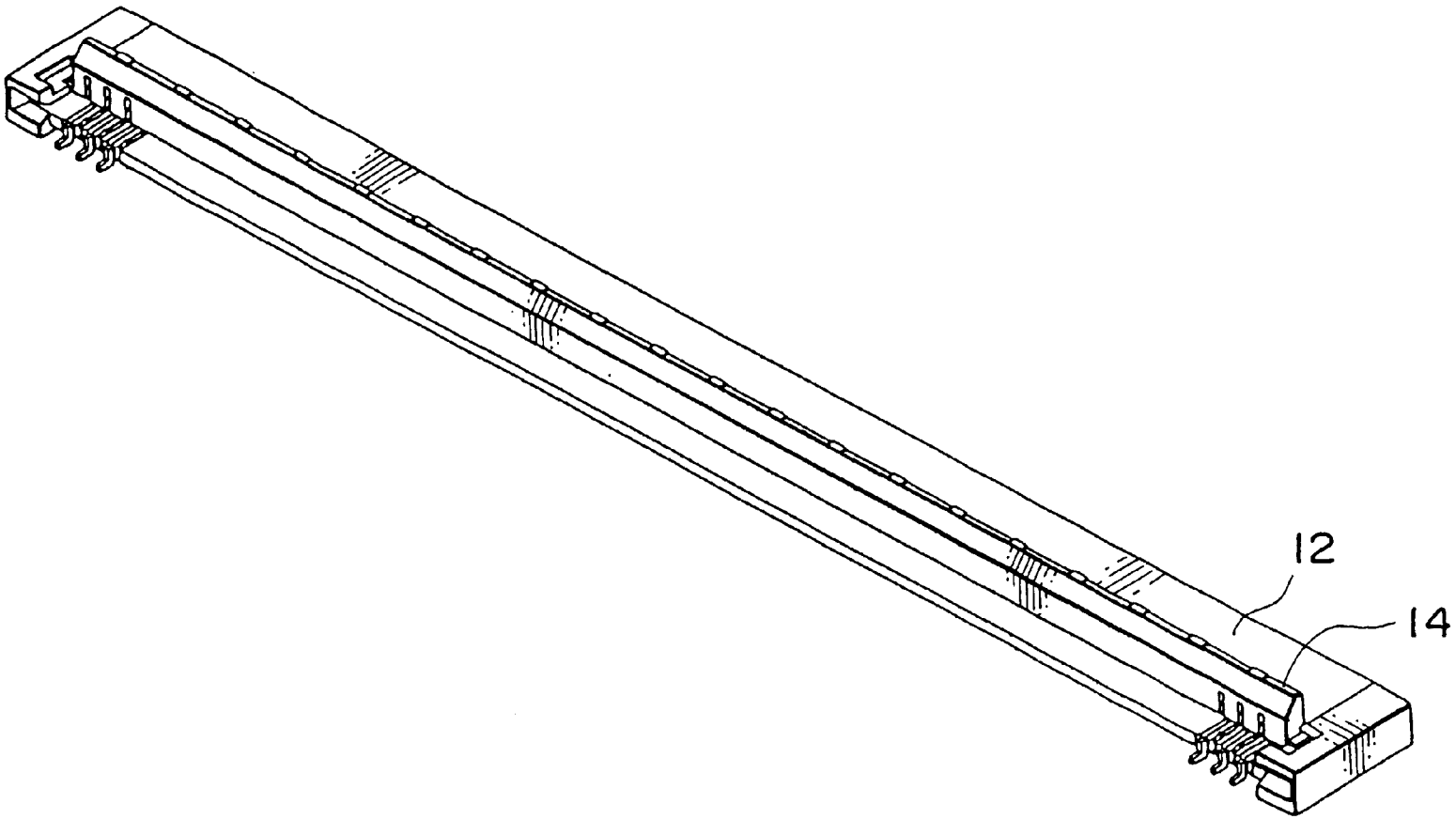
FIG. 5 is a perspective view of a connector according to a second embodiment of the present invention.
Figure 6A:
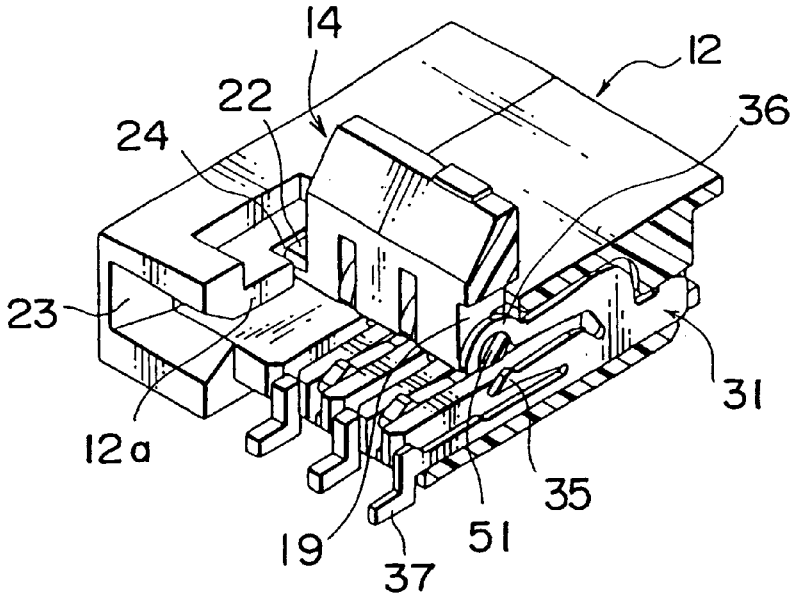
FIG. 6A is an enlarged perspective view obtained by cutting the connector illustrated in FIG. 5 at a first position.
Figure 6B:
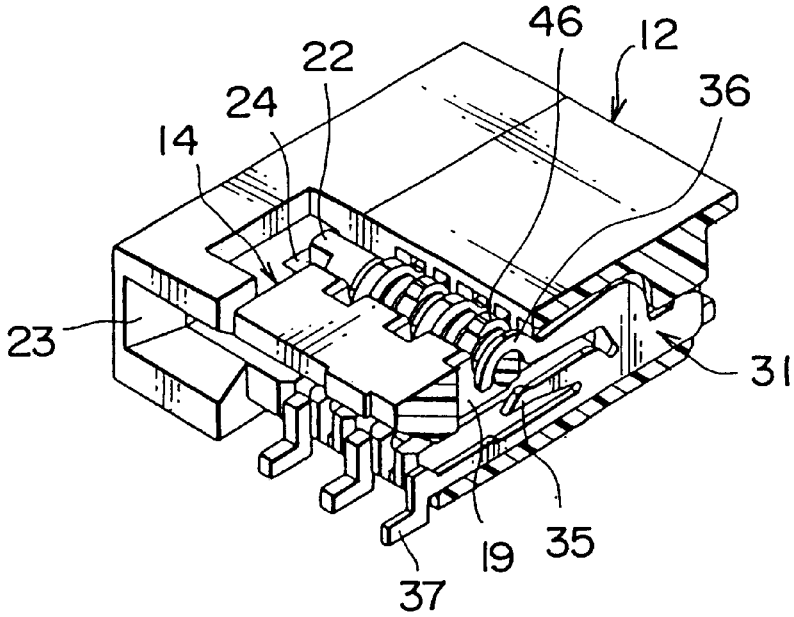
FIG. 6B is an enlarged perspective view similar to FIG. 6A except that the actuator is in a closed state.

In the state where the FPC 11 is inserted into the FPC insert portion 18, the actuator 14 is rotated from the first position in FIG. 4A to a second position illustrated in FIG. 4B. In this event, the FPC 11 is pressed by a pressing cum surface 21*b* of the cam portion 21 rotated from the laid position into a standing position. As a result, the FPC 11 is brought into press contact with the contacting portion 15, which is then elastically deformed, to achieve electrical connection. When the actuator 14 is at the second position where the actuator 14 is closed, the cam portion 21 is clamped between the supporting portion 16 and the contacting portion 15 through the FPC 11 to be subjected to the force to keep the actuator 14 closed. Thus, at the second position (closed position), the actuator 14 is prevented from being easily moved in a releasing direction, i.e., towards the first position.

With the above-mentioned connector, sufficient contacting force is assured with small operating force by utilizing the principle of the lever. Therefore, appropriate operability can be maintained even if the number of contacts is increased. The cam portions 21 of the actuator 14 are restricted in movement in three directions including, upward, leftward, and rightward directions by the supporting portions 16 of the contacts 13 and the engaging grooves 24 of the housing 12. Therefore, even if the number of contacts is increased, the cam portions 21 are prevented from being swept out by the friction between the FPC 11 and the cam portions 21 so that all of the contacts can be reliably connected.

As mentioned above, even if the number of contacts is great, the actuator 14 can be operated with small operating force and with high reliability. In addition, the reliability of connection is improved. Furthermore, the above-mentioned structure is advantageous in view of the reduction in size.

Since the shaft portions 22 are engaged with the engaging grooves 24 and the cam portions 21 are engaged with the recesses 17 of the supporting portions 16 of the contacts 13, the actuator 14 is prevented from being moved frontward to be released. Thus, even if the FPC 11 being connected is subjected to pull force, the risk of disengagement of the actuator 14 from the housing 12 is reduced.

Referring to FIGS. 5 through 10, description will be made of a connector according to a second embodiment of the present invention. Similar parts are designated by like reference numerals and will not be described any longer.

In the connector of the second embodiment, the above-mentioned contacts 13 are replaced by a number of first and second conductive elastic contacts 31 and 32. The first and the second contacts 31 and 32 are held in the housing 12 and alternately arranged at a predetermined pitch in the transversal direction. Thus, the first and the second contacts 31 and 32 are adjacent to each other in the transversal direction at the predetermined pitch.

Each of the first contacts 31 has a first contacting portion 35 to be faced to one surface of the FPC 11, a first supporting portion 36 to be faced to the other surface of the FPC 11 which is opposite to the one surface, and a first external connection terminal 37 formed below the first supporting portion 36 and extending frontward. The first contacting portion 35, the first supporting portion 36, and the first external connection terminal 37 are integrally formed. The first contacting portion 35 and the first supporting portion 36 are substantially faced to each other with a space kept therebetween in the vertical direction. The first supporting portion 36 is provided with a recess 38 formed at a position faced to the first contacting portion 35.

Each of the second contacts 32 has a second contacting portion 45 to be faced to the one surface of the FPC 11, a second supporting portion 46 to be faced to the other surface of the FPC 11 which is opposite to the one surface, and a second external connection terminal 47 extending rearward. The second contacting portion 45, the second supporting portion 46, and the second external connection terminal 46 are integrally formed. The second connecting portion 45 is located frontward from the second supporting portion 46. Each of the first and the second external connection terminals 37 and 47 are connected by soldering or the like to a circuit pattern of a circuit board (not shown) when the connector is mounted on the circuit board.

The actuator 14 has a number of first and second cam portions 51 and 52 to be engaged with the first and the second supporting portions 36 and 46, respectively. Each of the first cam portions 51 has a first pressing cam surface for pressing the other surface of the FPC 11 and an engaging cam surface to be engaged with the recess 38 of the first supporting portion 36 of the first contact 31. The first pressing cam surface and the engaging cam surface are placed at positions deferent from each other in a circular direction of each of the first cam portions 51. The actuator 14 is provided with a number of through holes 19 each of which is formed adjacent to the engaging cam surface. The first supporting portions 36 of the first contacts 31 are inserted into the through holes 19. Thus, the actuator 14 is rotatably supported by the first supporting portions 36 of the first contacts 31.

Figure 7A:
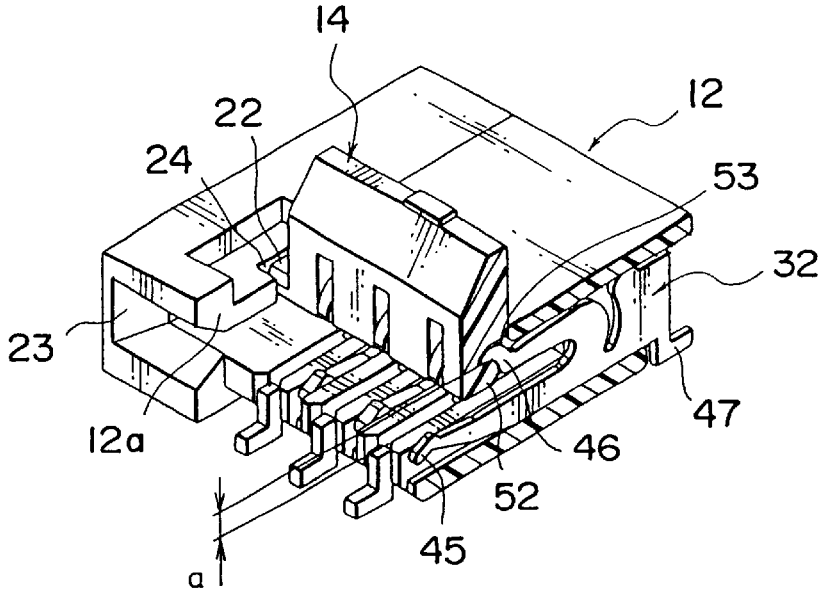
FIG. 7A is an enlarged perspective view obtained by cutting the connector illustrated in FIG. 5 at a second position.
Figure 7B:
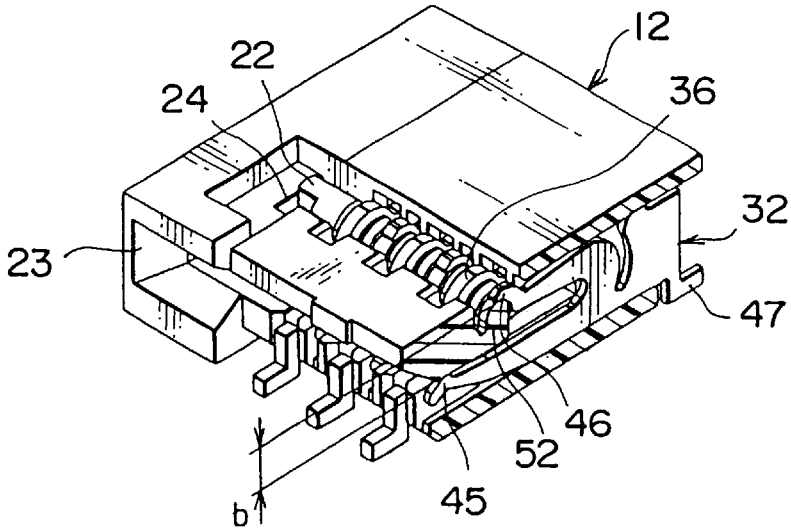
FIG. 7B is an enlarged perspective view similar to FIG. 7A except that the actuator is in the closed state.
Figure 8:
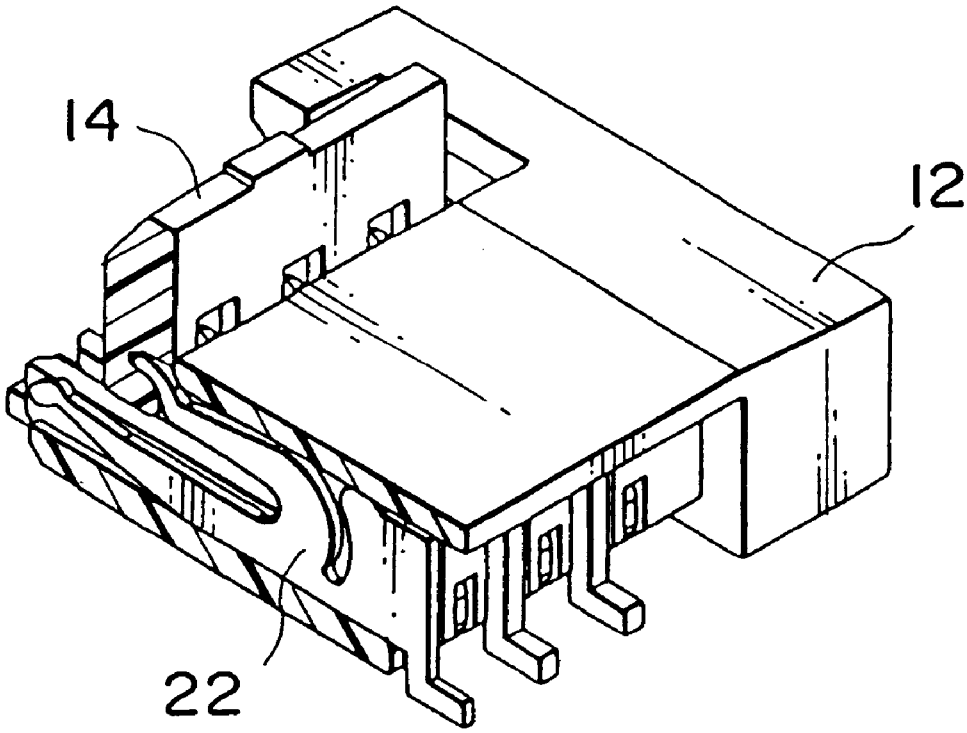
FIG. 8 is a view similar to FIG. 6A as seen in a different direction.
Figure 9:
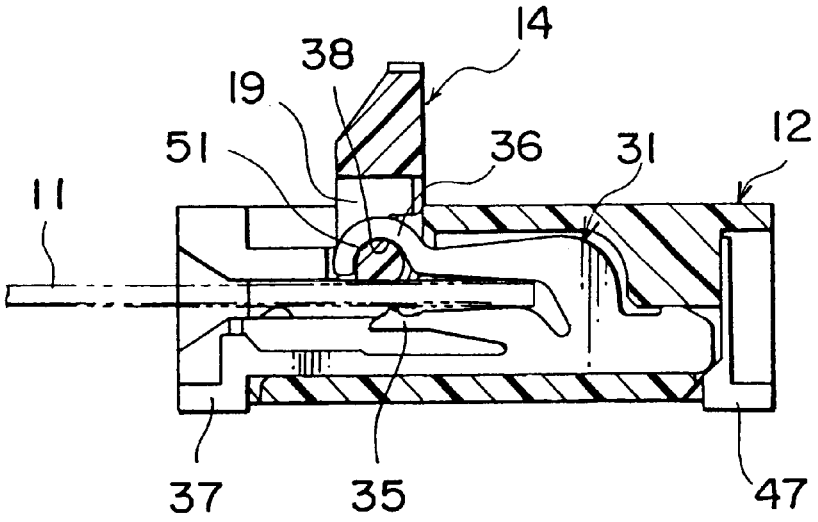
FIG. 9 is a sectional view corresponding to FIG. 6A.
Figure 10:
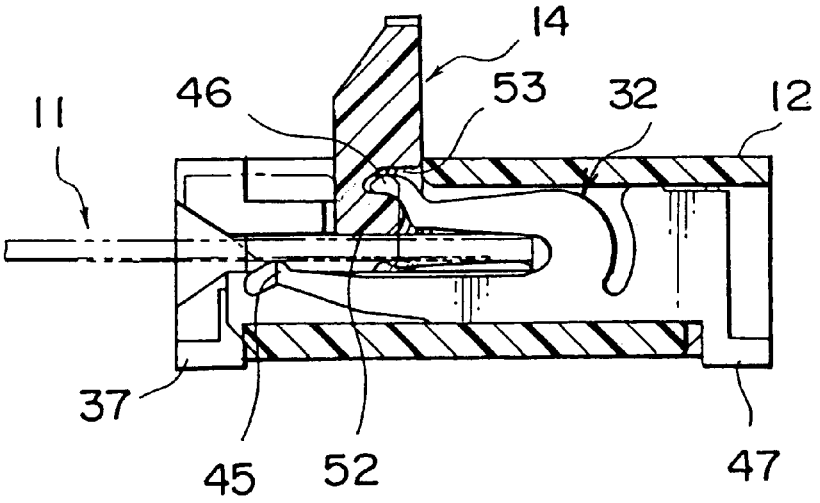
FIG. 10 is a sectional view corresponding to FIG. 7A.
Figure 11A:
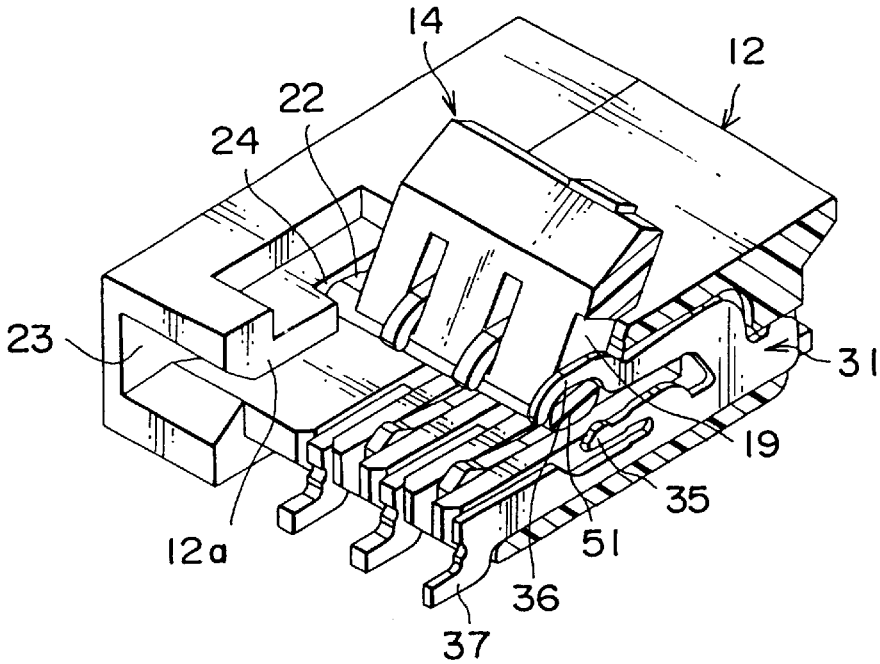
FIG. 11A is a perspective view of a connector according to a third embodiment of the present invention with an actuator in an opened state, as obtained by cutting the connector at a first position.
Figure 11B:
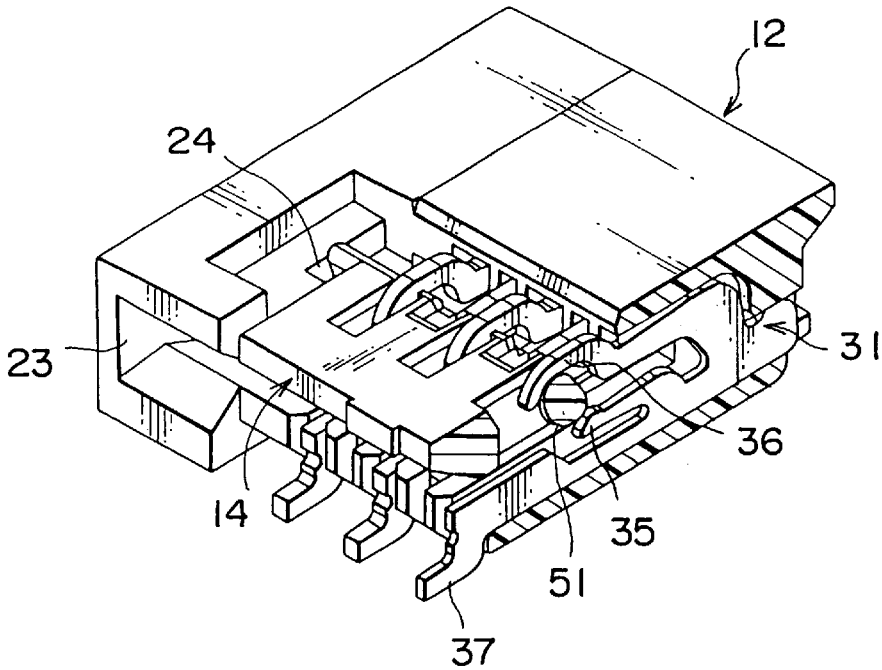
FIG. 11B is a perspective view similar to FIG. 11A except that the actuator is in a closed state.
Figure 12A:
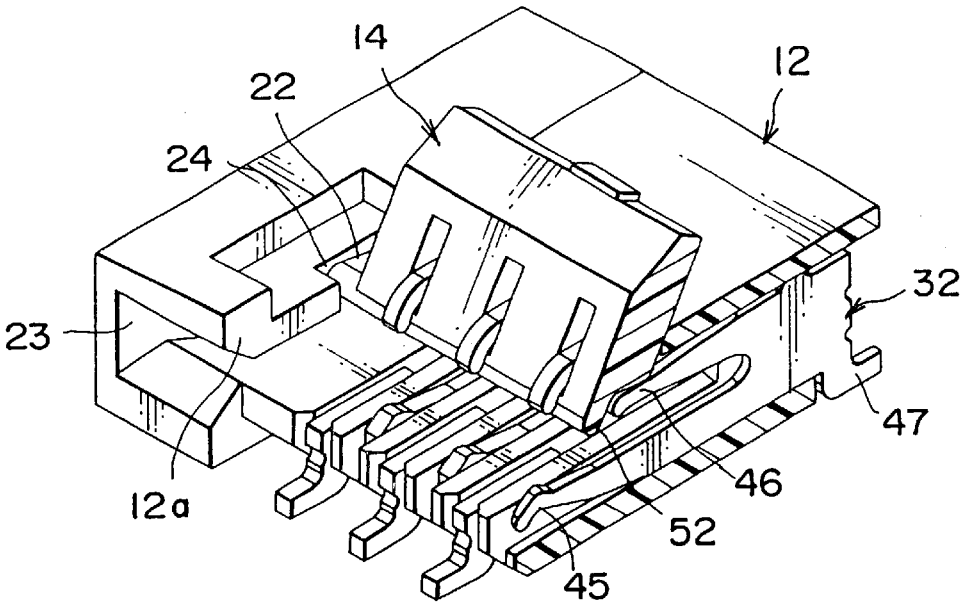
FIG. 12A is a perspective view similar to FIG. 11A but taken at a second position.
Figure 12B:
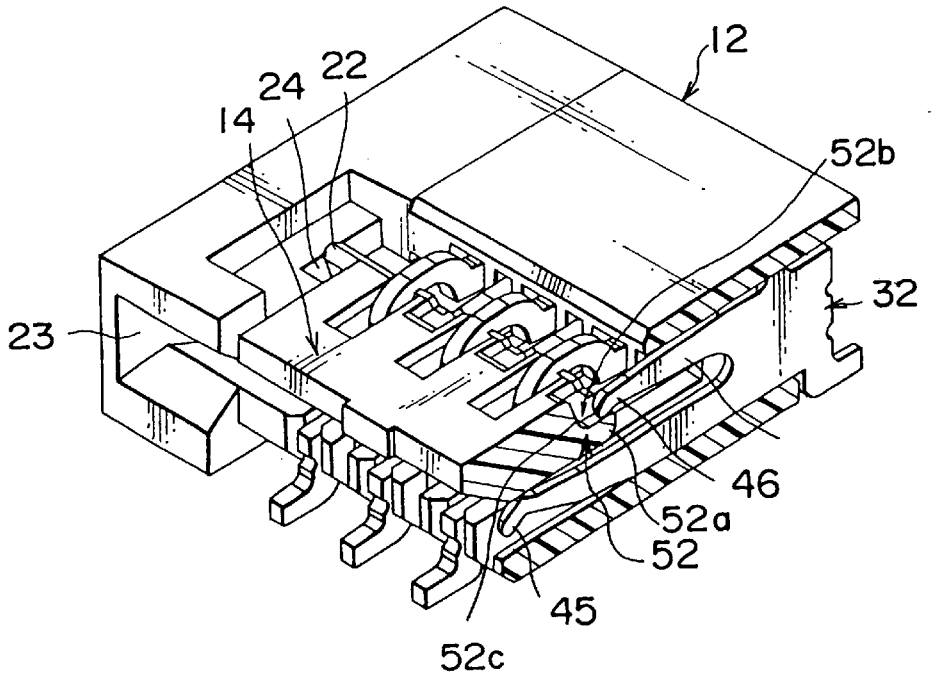
FIG. 12B is a perspective view similar to FIG. 12A except that the actuator is in a closed state.
Figure 13:
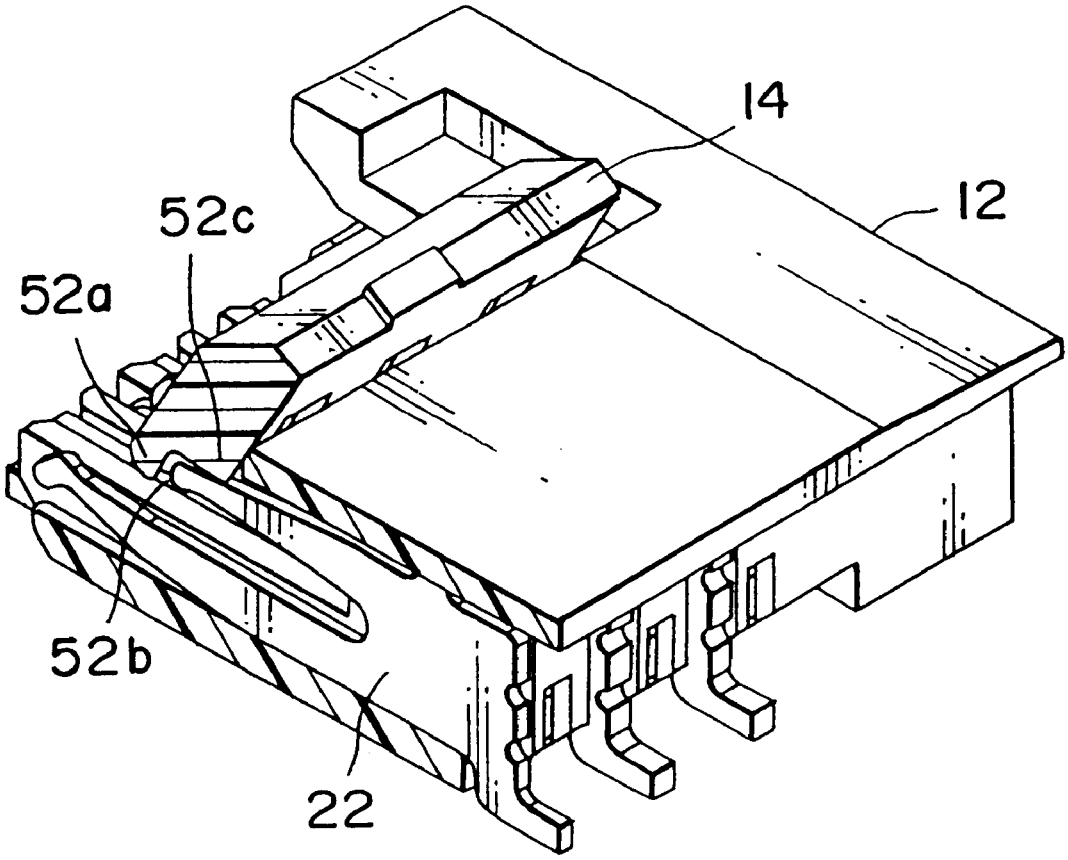
FIG. 13 is a view similar to FIG. 12A as seen in a different direction.
Figure 14A:
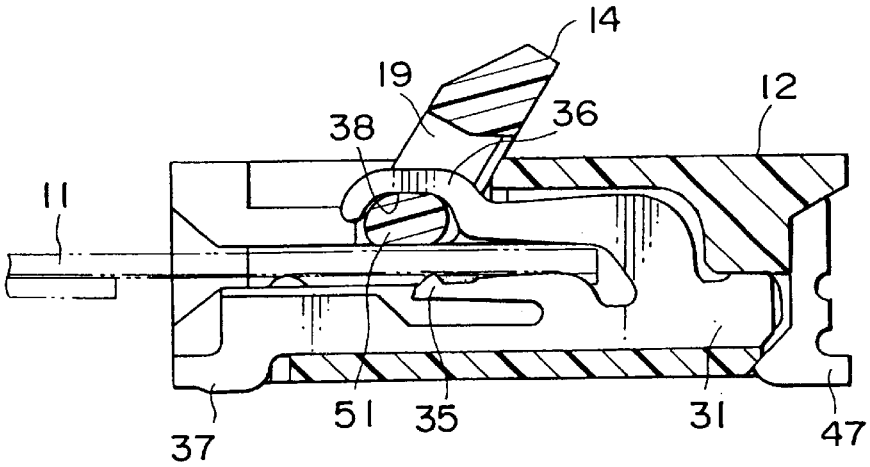
FIG. 14A is a sectional view corresponding to FIG. 11A.
Figure 14B:
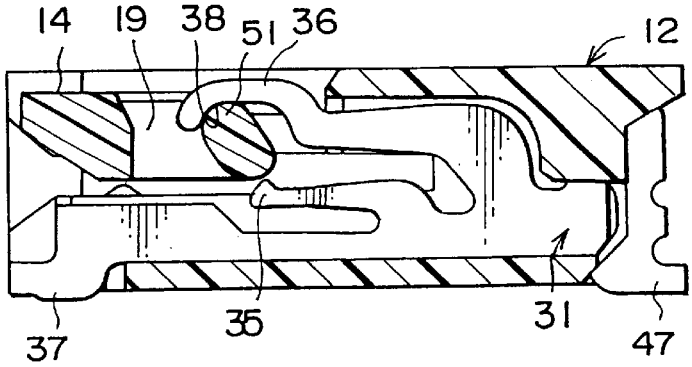
FIG. 14B, is a sectional view corresponding to FIG. 11B.
Figure 14C:
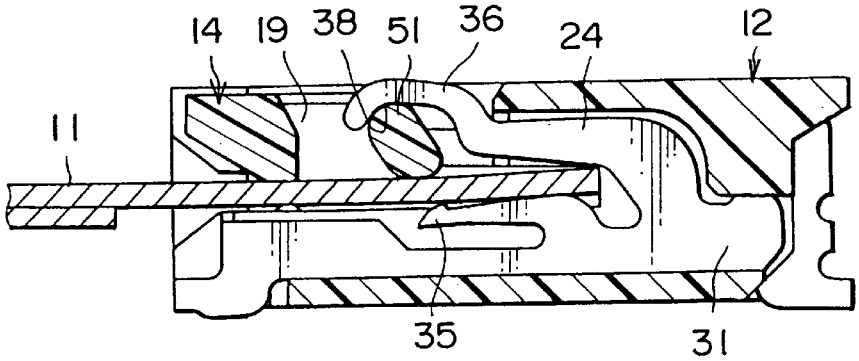
FIG. 14C is a sectional view similar to FIG. 14B with a sheet-like object connected to the connector.

On the other hand, each of the second cam portions 52 has a second pressing cam surface 52*a* for pressing the other surface of the FPC 11 and an engaging cam groove 53 for receiving the second supporting portion 46 of the second contact 32. As illustrated in FIGS. 7A and 7B, the second cam portion 52 has dimensions a and b selected so that the relationship a<b is satisfied.

With the above-mentioned connector, the operability is excellent upon insertion of the FPC 11 even if the FPC 11 has a large number of contacts extending in a longitudinal direction thereof. Furthermore, the shaft portions 22 are engaged with the engaging grooves 24 and the first cam portions 51 are engaged with the recesses 38 of the first supporting portions 36. Therefore, the actuator 14 is prevented from being moved frontward to be released. Thus, even if the FPC 11 being connected is subjected to pull force, the risk of disengagement of the actuator 14 from the housing 12 is reduced.

Referring to FIGS. 11A through 15C, description will be made of a connector according to a third embodiment of the present invention. Similar parts are designated by like reference numerals and will not be described any longer.

In the connector of the third embodiment, the actuator 14 has an opening angle selected to be equal to about 100°. Each of the first cam portions 51 has a section defined by two semicircles connected by two straight lines. The first supporting portion 36 of the first contact 31 has a shape adapted to be engaged with the first cam portion 51 of the above-mentioned shape. The second supporting portion 46 of the second contact 32 is slightly modified in shape.

On the other hand, each of the second cam portions 52 has the second pressing cam portion 52*a* and a generally L-shaped notch 52*b* formed by cutting off an edge of the second cam portion 52 and opened in two directions. Since the notch 52*b* is formed, the second pressing cam portion 52*a* serves as a reduced pressing portion.

Figure 15A:
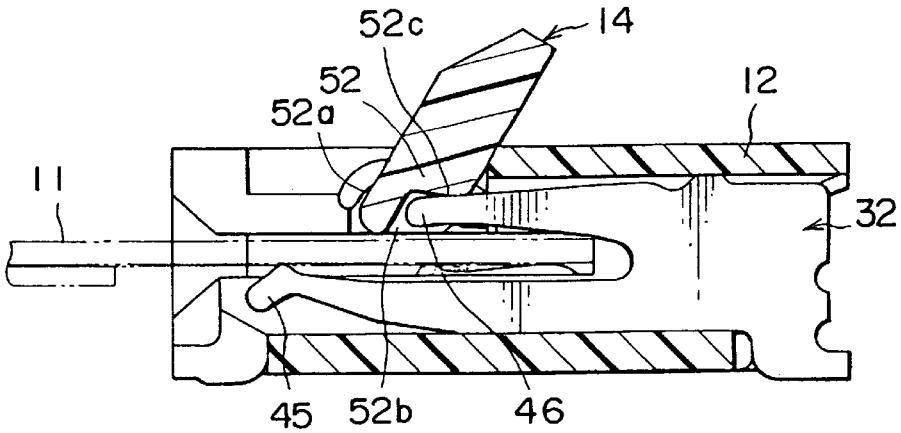
FIG. 15A is a sectional view corresponding to FIG. 12A.
Figure 15B:
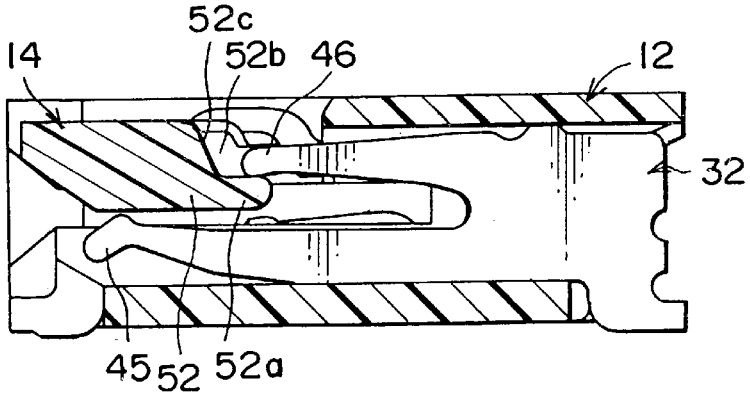
FIG. 15B is a sectional view corresponding to FIG. 12B.
Figure 15C:
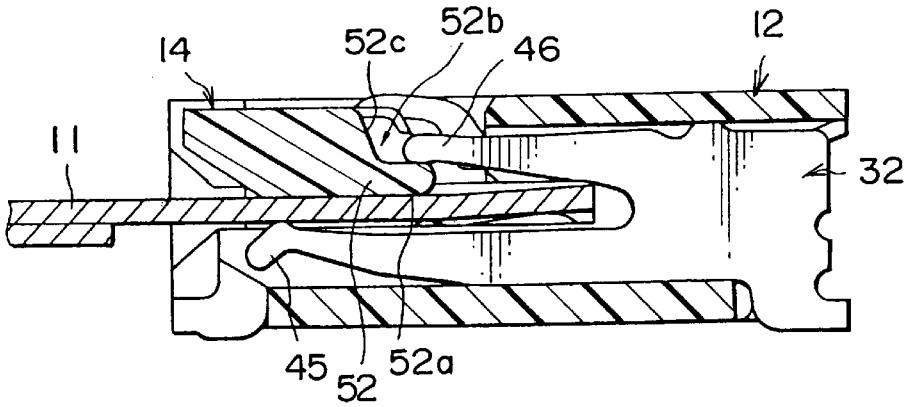
FIG. 15C is a sectional view similar to FIG. 15B with the sheet-like object connected to the connector.
Figure 16A:
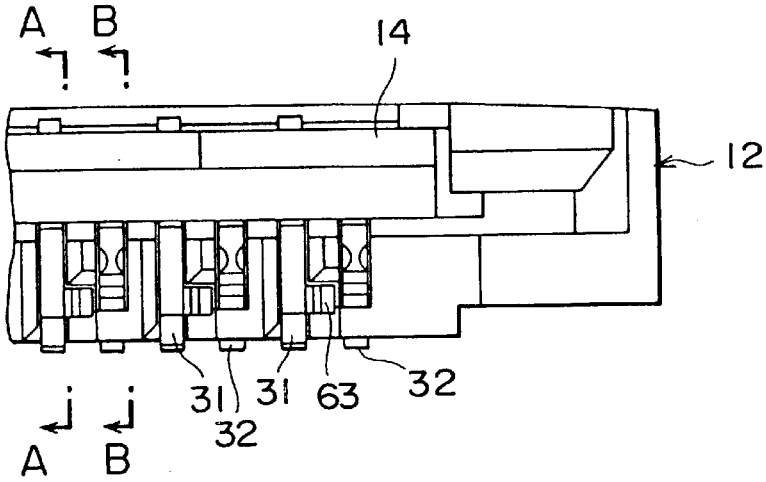
FIG. 16A is a front view of a part of a connector according to a fourth embodiment of the present invention.
Figure 16B:
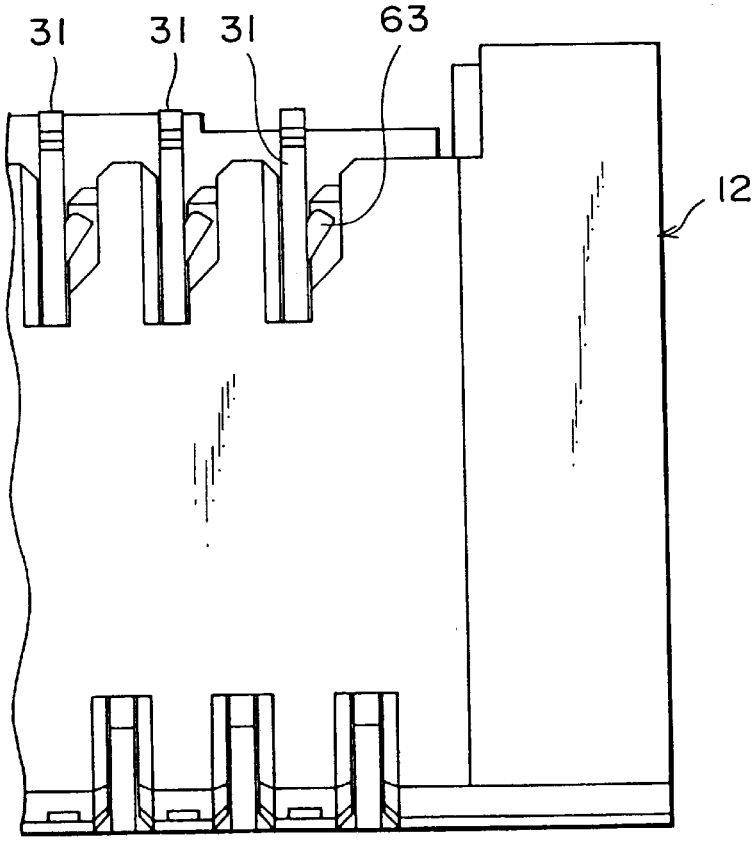
FIG. 16B is a bottom view corresponding to FIG. 16A.
Figure 17A:
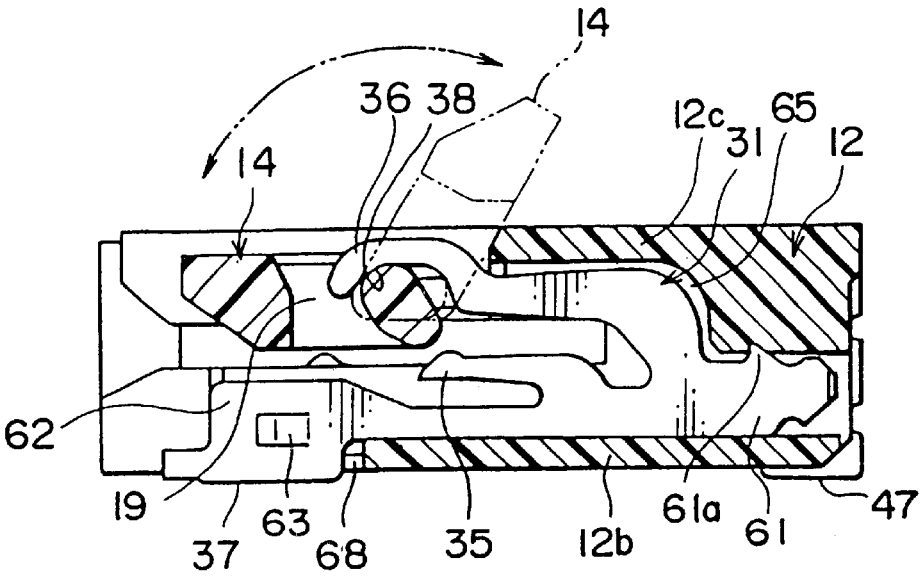
FIG. 17A is a sectional view taken along a line A—A in FIG. 16A.
Figure 17B:
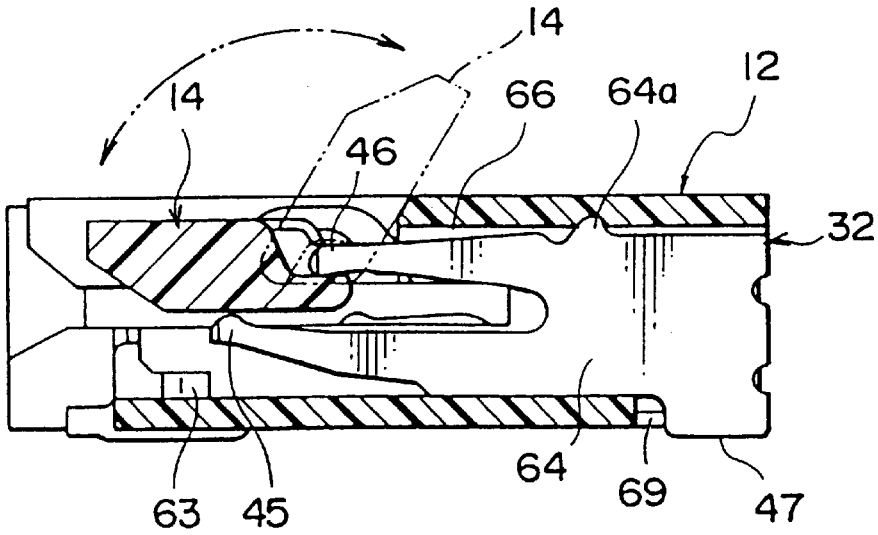
FIG. 17B is a sectional view taken along a line B—B in FIG. 16A.
Figure 18:
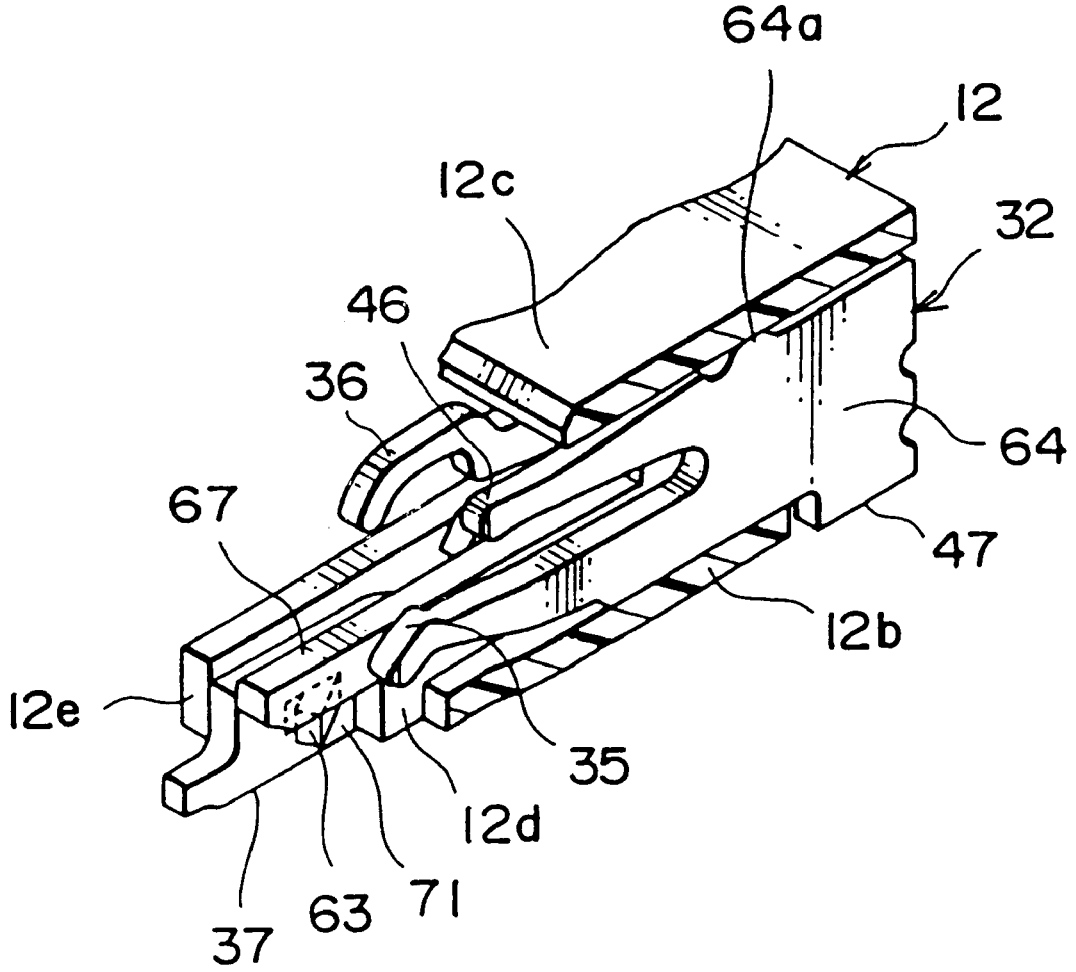
FIG. 18 is a perspective view corresponding to FIG. 17B.

When the actuator 14 is opened as illustrated in FIG. 1 5A, the second supporting portion 46 is locked by a bottom portion 52*c* of the notch 52*b* . When the actuator 14 is closed as illustrated in FIGS. 15B and 15C, the second supporting portion 46 is brought into contact with a neighborhood (inner edge) of the second pressing cam portion 52*a* . Thus, the second contact 32 locks the actuator 14.

Each of the first and the second cam portions 51 and 52 is brought into contact with the FPC 11 at a position where the first contacting portion 35 of the first contact 31 is pressed. Therefore, a stable and reliable contacting condition is achieved between the FPC 11 and the contacts.

With the above-mentioned connector, the operability is excellent upon insertion of the FPC 11 even if the FPC 11 has a large number of contacts extending in a longitudinal direction thereof. Furthermore, the shaft portions 22 are engaged with the engaging grooves 24 and the first cam portions 51 are engaged with the recesses 38 of the first supporting portions 36. Therefore, the actuator 14 is prevented from being moved frontward to be released. Thus, even if the FPC 11 being connected is subjected to pull force, the risk of disengagement of the actuator 14 from the housing 12 is reduced.

Referring to FIGS. 16A through 18, description will be made of a connector according to a fourth embodiment of the present invention. Similar parts are designated by like reference numerals and will not be described any longer.

In the connector of the fourth embodiment, each of the first contacts 31 has a first holding portion 61 formed at its rear part and held in the housing 12 by press fitting. The first holding portion 61 is provided with a first press-fit portion 61*a* protruding therefrom to be locked by the housing 12. The first contact 31 has a plate portion 62 formed in the vicinity of the first external connection terminal 37. The plate portion 62 is provided with a protrusion 63 formed by cutting and bending a part of its flat plane to protrude in the thickness direction.

Each of the second contacts 32 has a second holding portion 64 formed at its rear end and held in the housing 12 by press fitting. The second holding portion 64 is provided with a second press-fit portion 64*a* protruding therefrom to be locked by the housing 12.

The housing 12 has a generally box-like shape elongated in one direction. The housing 12 comprises a mount-side plate portion 12*b*, a top plate portion 12*c*, and first and second partition wall portions 12*d* and 12*e*. The mount-side plate portion 12*b*, the top plate portion 12*c*, and the first and the second partition wall portions 12*d* and 12*e* define a plurality of first receptacle holes 65 for receiving the first contacts 31 and a plurality of second receptacle holes 66 for receiving the second contacts 32. Each of the first and the second receptacle holes 65 and 66 penetrates the housing 12 in the back-and-forth direction (second direction). Each of the first partition wall portions 12*d* has a stopper portion 67 formed at its end. The stopper portion 67 is engaged with the protrusion 63 of the first contact 31 to inhibit upward movement of the first contact 31.

The first external connection terminal 37 is slightly protruded downward from a notch 68 formed by cutting an end of the mount-side plate portion 12*b*. On the other hand, the second external connection terminal 47 is slightly protruded downward from a notch 69 formed by cutting an end of the mountside plate portion 12*b*.

The first receptacle hole 65 has a rear part reduced in size in the vertical direction. In the rear part of the first receptacle hole 65, the first holding portion 61 of the first contact 31 is located. The second receptacle hole 66 has a rear part in which the second holding portion 62 of the second contact 32 is located.

The first contact 31 is coupled to the housing 12 from its front side. On the other hand, the second contact 32 is coupled to the housing 12 from its rear side. After coupling the contacts, the protrusion 63 of each of the first contacts 31 is prevented by the stopper portion 67 from being moved upward. This improves positional accuracy of the first external connection terminal 37 and prevents the first external connection terminal 37 from being rotated around the first press-fit portion 61*a* to move upward even if external force is applied in an upward direction.

The protrusion 63 is received in a receiving portion 71 which may be a simple groove or recess. Alternatively, the receiving portion 71 may be formed so that the first and the second receiving holes 65 and 66 communicate with each other.

With the above-mentioned connector, the shaft portions 22 are engaged with the engaging grooves 24 and the first cam portions 51 are engaged with the recesses 38 of the first supporting portions 36. Therefore, the actuator 14 is prevented from being moved frontward to be released. In addition, the first contacts 31 are reliably prevented from upward movement so that the first cam portions 51 and the recesses 38 of the first supporting portions 36 are inhibited from being disengaged from each other. Furthermore, the upward movement of the first contact 31 is prevented by engagement between the protrusion 63 protruding from the flat plane of the first contact 31 and the stopper portion 67 of the housing 12. Therefore, the dimension of the connector in the vertical direction need not be increased.

What is claimed is:

1. A connector for use in connecting a sheet-like object said connector comprising:

a contact having a contacting portion to be faced to one surface of said sheet-like object and a supporting portion to be faced to the other surface of said sheet-like object which is opposite to the one surface;

a housing holding said contact; and an actuator for bringing said sheet-like object into press contact with said contacting portion, said actuator comprising a cam portion located between said supporting portion and said sheet-like object and a shaft portion integrally connected with said cam portion and rotatably engaged with said housing, said supporting portion have a recess which is recessed in a direction perpendicular to said sheet-like object, said recess receiving said cam portion to cause said cam portion and said supporting portion to engage each other in a direction parallel to said sheet-like object and perpendicular to a center axis of said shaft portion.

2. A connector as claimed in claim 1, wherein said housing has a guide groove for guiding said shaft portion so as to introduce said cam portion to an area between said contacting portion and said supporting portion, and an engaging groove connected to said guide groove and extending in a direction allowing movement of said cam portion towards said supporting portion, said shaft portion being rotatably engaged with said engaging groove.

3. A connector as claimed in claim 2, wherein said contacting portion and said supporting portion are faced to each other in a first direction, said sheet-like object being inserted between said contacting portion and said supporting portion with its movement in a second direction perpendicular to said first direction, said guide groove extending in said second direction, said engaging groove being engaged with said shaft portion in said second direction.

4. A connector as claimed in claim 2, wherein said housing has a wall portion defining one side surface of said guide groove, said engaging groove being a notch formed in said wall portion.

5. A connector as claimed in claim 2, wherein said housing and said supporting portion cooperate to rotatably support said actuator.

6. A connector as claimed in claim 1, wherein said cam portion has a pressing cam surface for pressing the other surface of said sheet-like object and an engaging cam surface engaged with said supporting portion, said actuator having a through hole adjacent to said engaging cam surface, said supporting portion being inserted into said through hole.

7. A connector for use in connecting a sheet-like object, said connector comprising:

a first contact having a first contacting portion to be faced to one surface of said sheet-like object and a first supporting portion to be faced to the other surface of said sheet-like object which is opposite to said one surface;

a second contact having a second contacting portion to be faced to said one surface of a sheet-like object and a second supporting portion to be faced to the other surface of said sheet-like object;

a housing holding said first and said second contacts at a predetermined pitch; and an actuator for bringing said sheet-like object into press contact with said first and said second contacting portions, said actuator comprising:

a first cam portion located between said first supporting portion and said sheet-like object;

a second cam portion located between said second supporting portion and said sheet-like object; and a shaft portion integrally connected with said first and said second cam portions and rotatably engaged with said housing, said first supporting portion having a recess which is recessed in a direction perpendicular to said sheetlike object, said recess receiving said first cam portion to cause said first cam portion and said first supporting portion to engage each other in a predetermined direction parallel to said sheet-like object and perpendicular to a center axis of said shaft portion.

8. A connector as claimed in claim 7, wherein said first cam portion has a first pressing cam surface for pressing the other surface of said sheet-like object and a first engaging cam surface engaged with said first supporting portion, said actuator having a through hole adjacent to said engaging cam surface, said first supporting portion being inserted into said through hole.

9. A connector as claimed in claim 7, wherein said second cam portion has a second pressing cam surface for pressing the other surface of said sheet-like object and an engaging cam groove receiving said second supporting portion.

10. A connector as claimed in claim 7, wherein said first and said second contacting portions are shifted in position from each other in said predetermined direction.

11. A connector as claimed in claim 10, wherein said shaft portion has a center axis located between said first and said second contacting portions in said predetermined direction.

12. A connector as claimed in claim 7, wherein said first contact further has a first holding portion formed at one end thereof in said predetermined direction and held in said housing and an external connection terminal formed at the other end in said predetermined direction.

13. A connector as claimed in claim 12, wherein said external connection terminal is located on the side of the other surface of said sheet-like object.

14. A connector as claimed in claim 13, wherein said first contact has a plate portion formed in the vicinity of said external connection terminal, said plate portion being engaged with said housing to be inhibited from movement towards said sheet-like object connected to said connector.

15. A connector as claimed in claim 14, wherein said plate portion has a protrusion protruding in a direction parallel to a center axis of said shaft portion, said housing having a stopper portion to be engaged with said protrusion.

16. A connector as claimed in claim 1, further comprising an additional contact adjacent to the first-mentioned contact in a direction parallel to a center axis of said shaft portion, said additional contact having a contacting portion to be faced to the one surface of said sheet-like object and a supporting portion to be faced to the other surface of said sheet-like object which is opposite to the one surface, said actuator further comprising an additional cam portion integrally connected with said shaft portion, said additional cam portion being located between the supporting portion of said additional contact and said sheet-like object to receive the supporting portion of said additional contact in the first-mentioned direction without being engaged with the supporting portion of said additional contact in the second-mentioned direction.

* * * * *

UNITED STATES PATENT AND TRADEMARK OFFICE

CERTIFICATE OF CORRECTION

PATENT NO. : 6,431,897 B1
DATED : August 13, 2002
INVENTOR(S) : Osamu Hashiguchi and Kanji Inoue It is certified that error appears in the above-identified patent and that said Letters Patent is hereby corrected as shown below:

Column 1,
Line 33, after “hereinafter” insert -- be --

Column 4,
Line 65, delete “cum” and insert -- cam --

Column 6,
Line 1, delete “46” (second occurrence) and insert -- 47 --
Line 2, delete “connecting” and insert -- contacting --

Column 8,
Line 39, delete “have” and insert -- having --

Signed and Sealed this

Fourth Day of May, 2004

JON W. DUDAS
*Acting Director of the United States Patent and Trademark Office*